US007398565B1

(12) United States Patent
Chou

(10) Patent No.: US 7,398,565 B1
(45) Date of Patent: Jul. 15, 2008

(54) SELF-CLEANING URINAL ANTI-SPLASH DEVICE

(76) Inventor: Michael C. Chou, 901 Solvay Aisle, Irvine, CA (US) 92606

( * ) Notice: Subject to any disclaimer, the term of this patent is extended or adjusted under 35 U.S.C. 154(b) by 118 days.

(21) Appl. No.: 11/514,442

(22) Filed: Sep. 1, 2006

Related U.S. Application Data

(60) Provisional application No. 60/713,771, filed on Sep. 2, 2005.

(51) Int. Cl.
*E03D 13/00* (2006.01)

(52) U.S. Cl. ..... 4/310; 4/300.3

(58) Field of Classification Search ..... 4/300.3, 4/310

See application file for complete search history.

(56) References Cited

U.S. PATENT DOCUMENTS

| | | | | |
|---|---|---|---|---|
| 652,037 | A * | 6/1900 | Naumann | 4/310 |
| 1,114,670 | A | 10/1914 | Baker | |
| 1,379,206 | A | 5/1921 | O'Hara | |
| 3,597,772 | A | 8/1971 | Leavitt | |
| 4,574,403 | A | 3/1986 | Dintemann et al. | |
| 5,027,448 | A | 7/1991 | Wilkins | |
| 5,165,119 | A | 11/1992 | Yamato | |
| 5,287,563 | A | 2/1994 | Peters | |
| 5,365,616 | A | 11/1994 | Morad | |
| 5,398,347 | A | 3/1995 | Luedtke et al. | |
| 6,055,681 | A | 5/2000 | Lyons | |

* cited by examiner

*Primary Examiner*—Charles E Phillips

(57) ABSTRACT

A self-cleaning urinal anti-splash device having a series of angled deflectors which send the urine stream ever deeper into a series of channels leading down toward the urinal drain. The angled deflectors not only send the urine stream ever deeper into the channels, but they simultaneously prevent the urine from exiting the channels in any direction other than downward toward the drain. This is accomplished by virtue of the fact that inner faces of the deflectors are adapted to deflect the urine back toward the urinal wall. No plane perpendicular to the direction of the initial urine stream is presented to the user. Gravity then causes it to flow to the drain. The device is also self cleaning because there is nothing to prevent the water of a flush cycle from passing through the vertical channels by gravity feed, thereby removing all the urine on the deflector surfaces. The device can be made of metal, plastic, rubber, or other inexpensive easily moldable substance. It has notches in the channels so the device is easily trimmed to size.

4 Claims, 7 Drawing Sheets

SELF-CLEANING URINAL ANTI-SPLASH DEVICE

CROSS REFERENCE TO RELATED APPLICATIONS

This application claims the benefit of provisional patent application Ser. No. 60/713,771, filed 2005 Sep. 2.

STATEMENT REGARDING FEDERALLY SPONSORED RESEARCH OR DEVELOPMENT

This invention was not made using Federally Sponsored Research and Development. The inventor retains all rights.

BACKGROUND OF INVENTION

1. Field of Invention

This invention relates to the sanitation industry, specifically where urinals are used to discard urine.

2. Prior Art

Several inventors have attempted to address the problem of preventing urine splash back from urinal walls. Commonly, these inventors make a plastic mat like device which is placed over the drain and has a textured surface; usually with a series of upright spike-like members or a grid pattern (U.S. Pat. Nos. 5,365,616, 5,398,347, 3,597,772 and 4,574,403). These inventions do not prevent all splash back, but merely deflect the direction of the splash in a hopefully harmless direction. It does not always work that way. Frequently the anti-splash device creates the additional problem of an extra part to the urinal that is not easy to clean or must be changed regularly.

Other times, prior art has seen some inventions that try and deflect urine away from the user, but it is done so by forcing the user to carefully aim their urine (U.S. Pat. No. 1,379,206). Unfortunately, if the user aims directly at the gaps in this device, urine will hit the back wall and splash back. Also, other devices are not cleaned thoroughly during a regular flush cycle (U.S. Pat. No. 5,287,563, U.S. Pat. No. 6,055,681). The flushing of the water comes through holes against the back wall of the urinal so if the deflectors are far away from the back wall, the deflectors will not be cleaned. Furthermore, inventors have tried to go with convoluted designs of entire urinal systems (U.S. Pat. Nos. 1,114,670 and 5,027,448). These devices still require some aiming by the user and also make the manufacturability of the device more difficult.

BRIEF SUMMARY OF THE INVENTION

This invention solves the problems seen in earlier urinal anti-splash devices because this invention uses a series of angled deflectors which send the urine stream ever deeper into a series of channels leading down toward the urinal drain. The angled deflectors not only send the urine stream ever deeper into the channels, but they simultaneously prevent the urine from exiting the channels. This is accomplished by virtue of the fact that inner faces of the deflectors are adapted to deflect the urine back toward the urinal wall. The operation of the device is much like the barb of a hook or an arrow. Put another way, it is much like the valve of a heart. The deflectors do everything to encourage the urine toward the rear wall of the urinal, and yet they do not permit the urine to exit the channels once it has entered the channels, except to flow down to the drain. The device is also self-cleaning because there is nothing to prevent the water of a flush cycle from passing through the channels by gravity feed, thereby removing all the urine on the deflector surfaces.

DETAILED DESCRIPTION OF THE INVENTION

This invention prevents urine splash-back from urinals by means of a series of channels formed between arrowhead shaped deflector vanes. The extent the arrowhead shaped deflector vanes protrude from the wall of the urinal is staggered from one row to the next. Thus, there is an initial or outer deflector vane next to an inner or secondary deflector vane which is in turn next to an outer deflector vane in a repeating pattern. The deflector vanes are so disposed as to present vertical channels between them, essentially parallel with the direction fluids flow when they are under the influence of gravity. The result is that urine is directed toward the urinal drain and flush water is directed along the same channels so the urinal is self-cleaning. There are no surfaces perpendicular to the initial direction of the urine stream and so there is minimal to no splash back.

Figure 1:
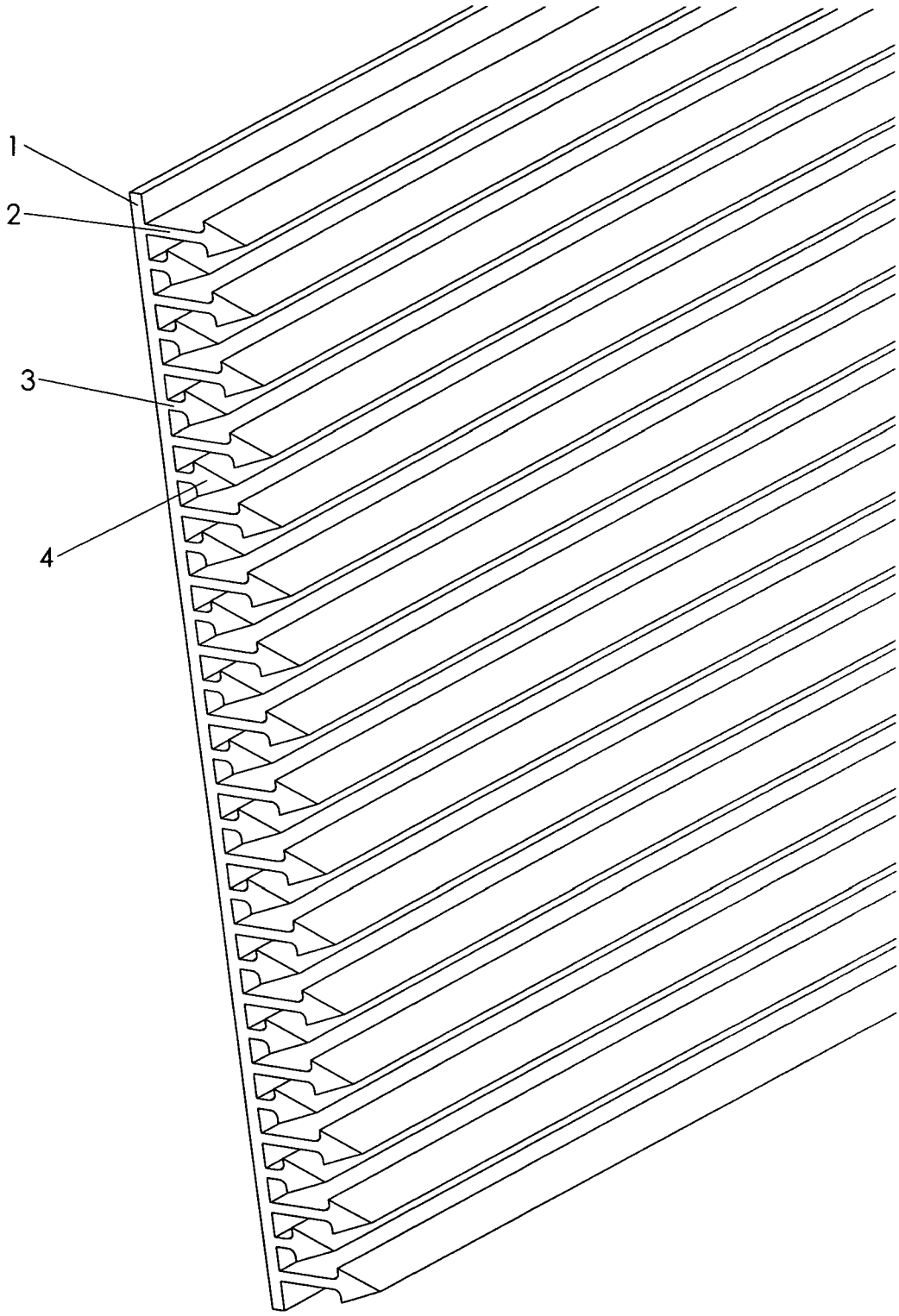
FIG. 1 is a frontal/bottom view of the operative portion of the invention.
Figure 2:
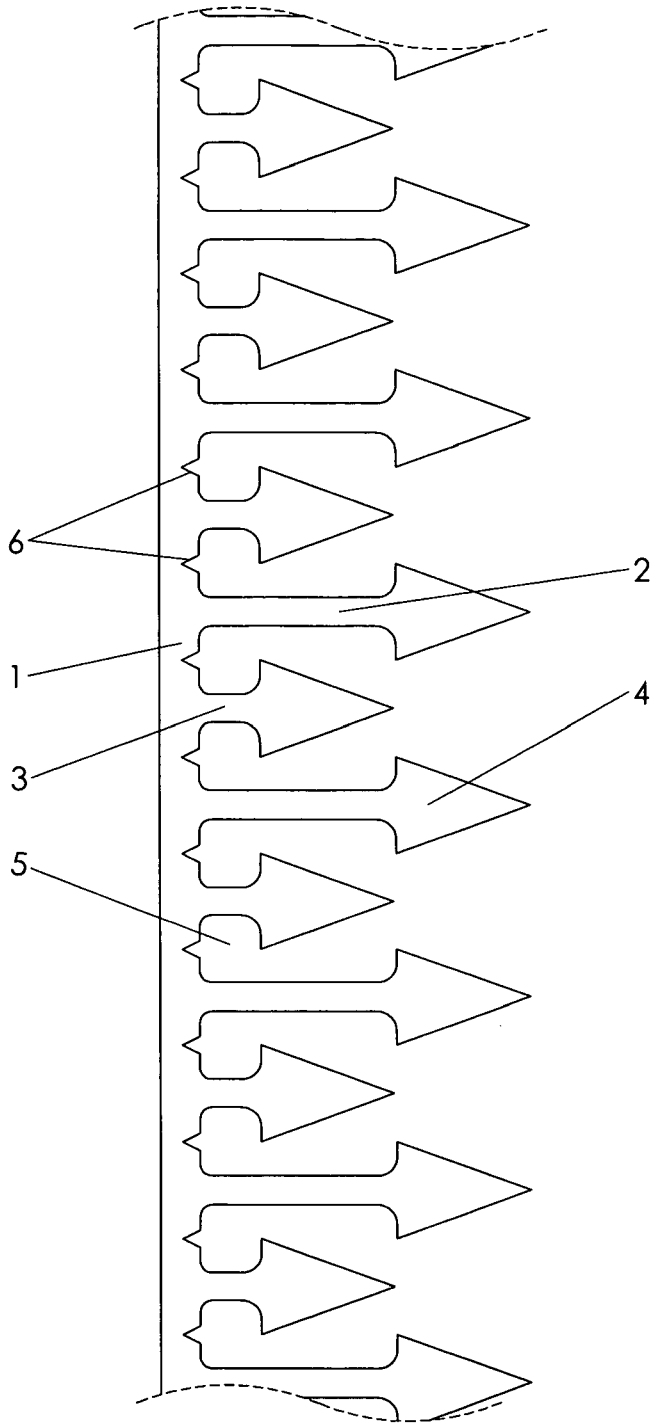
FIG. 2 is a cross-sectional view of the operative structure of the preferred embodiment.
Figure 3:
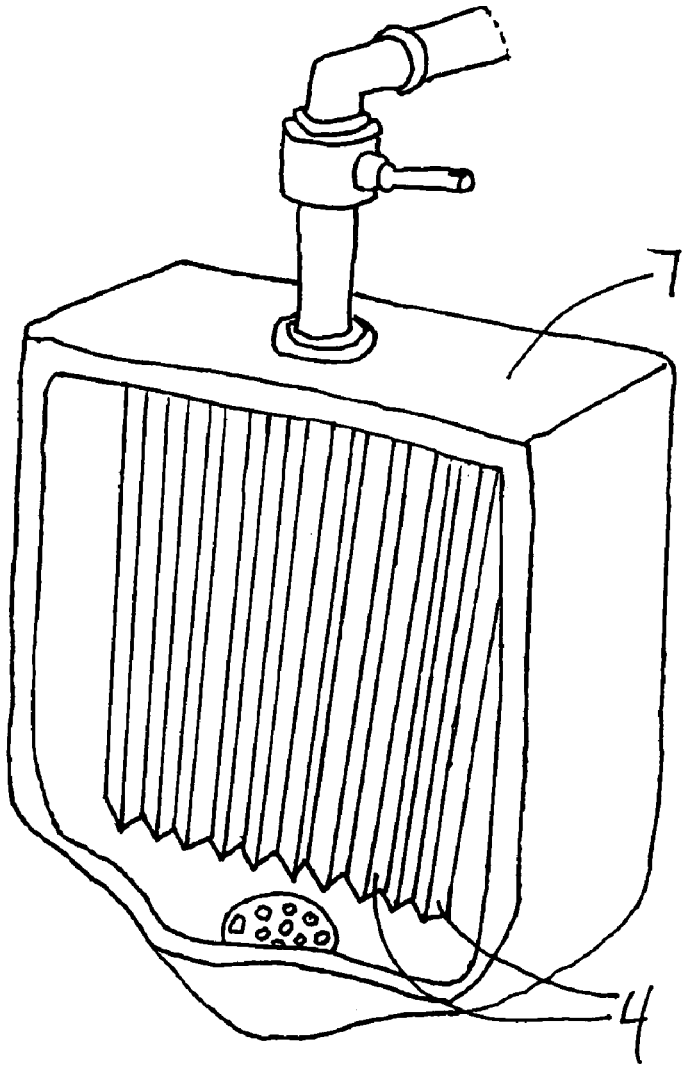
FIG. 3 shows the invention as installed in a typical urinal.
Figure 4:
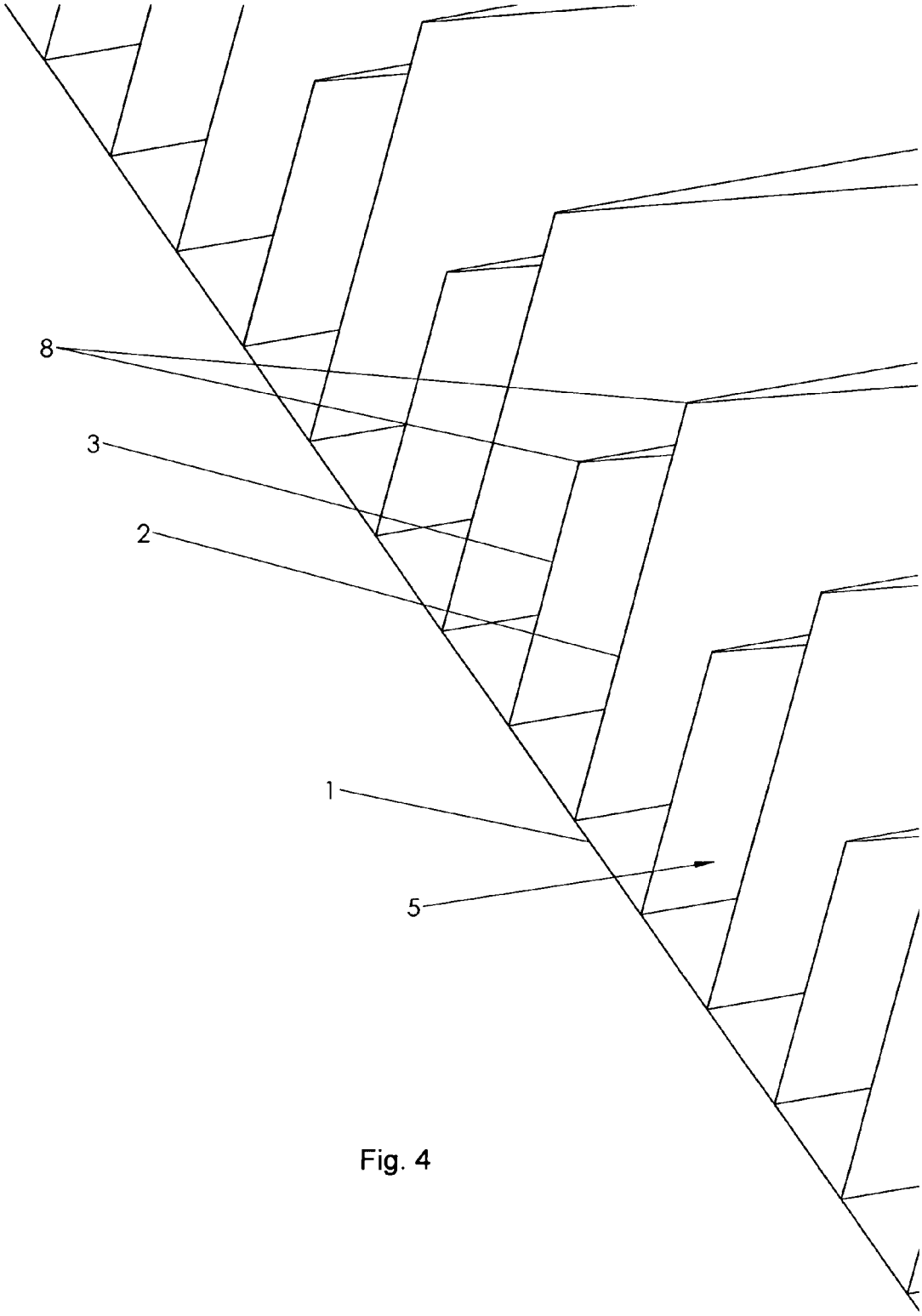
FIG. 4 shows the top edges of the invention.
Figure 5:
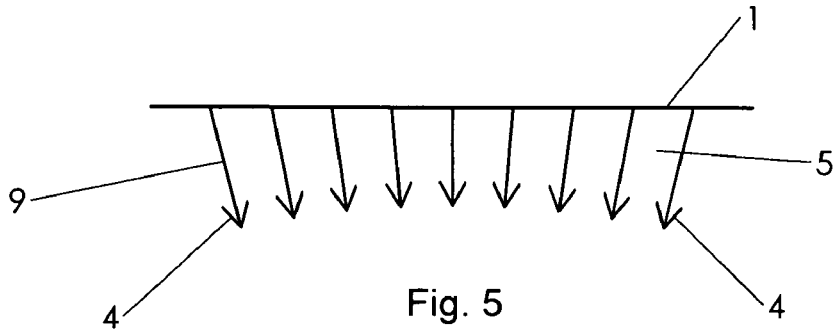
FIG. 5 shows an alternative embodiment having angularly converging vanes in cross section.
Figure 6:
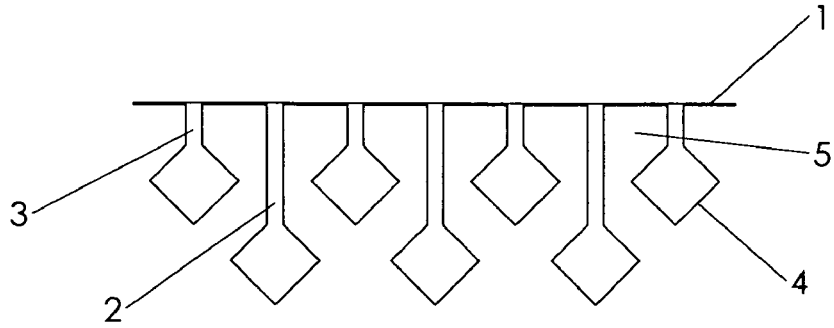
FIG. 6 shows a cross section of an embodiment having quadrangular processes on the vanes.
Figure 7:
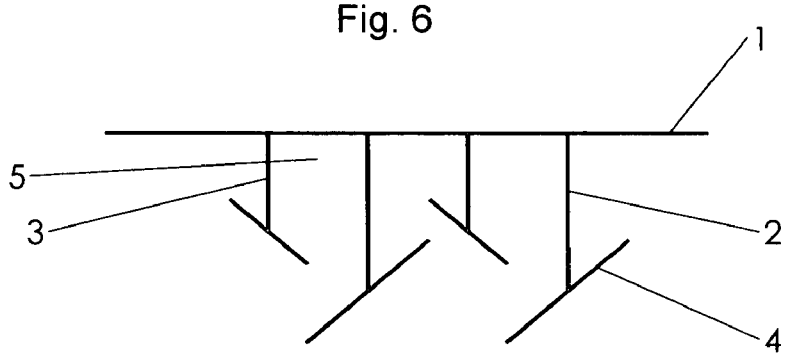
FIG. 7 shows a cross section of an alternative embodiment of the deflector vanes.
Figure 8:
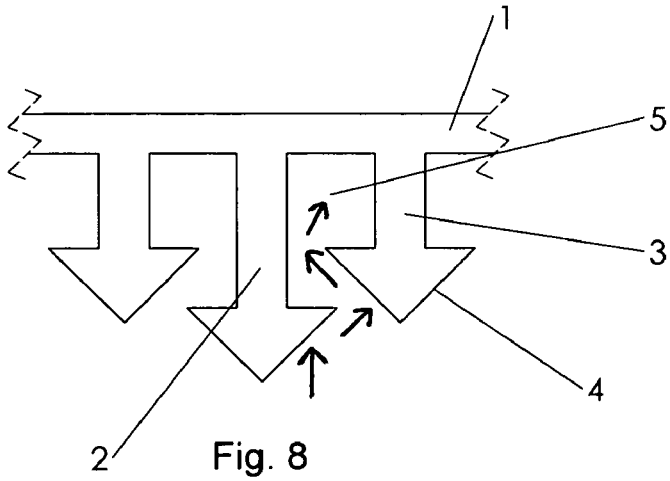
FIG. 8 shows a cross section of the preferred embodiment showing urine flow direction.
Figure 9:
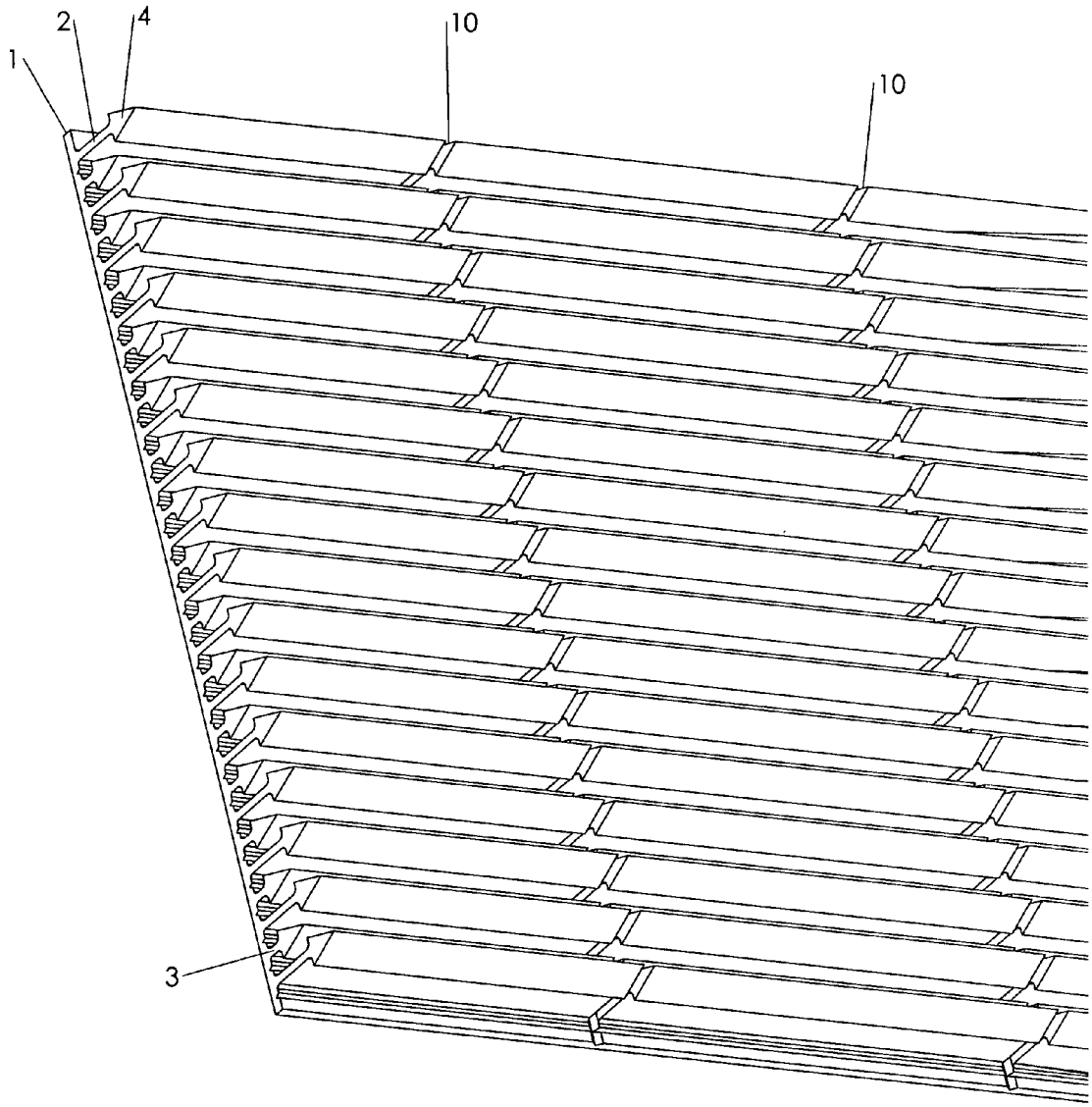
FIG. 9 shows a frontal/bottom view with an easy installation feature.
Figure 10:
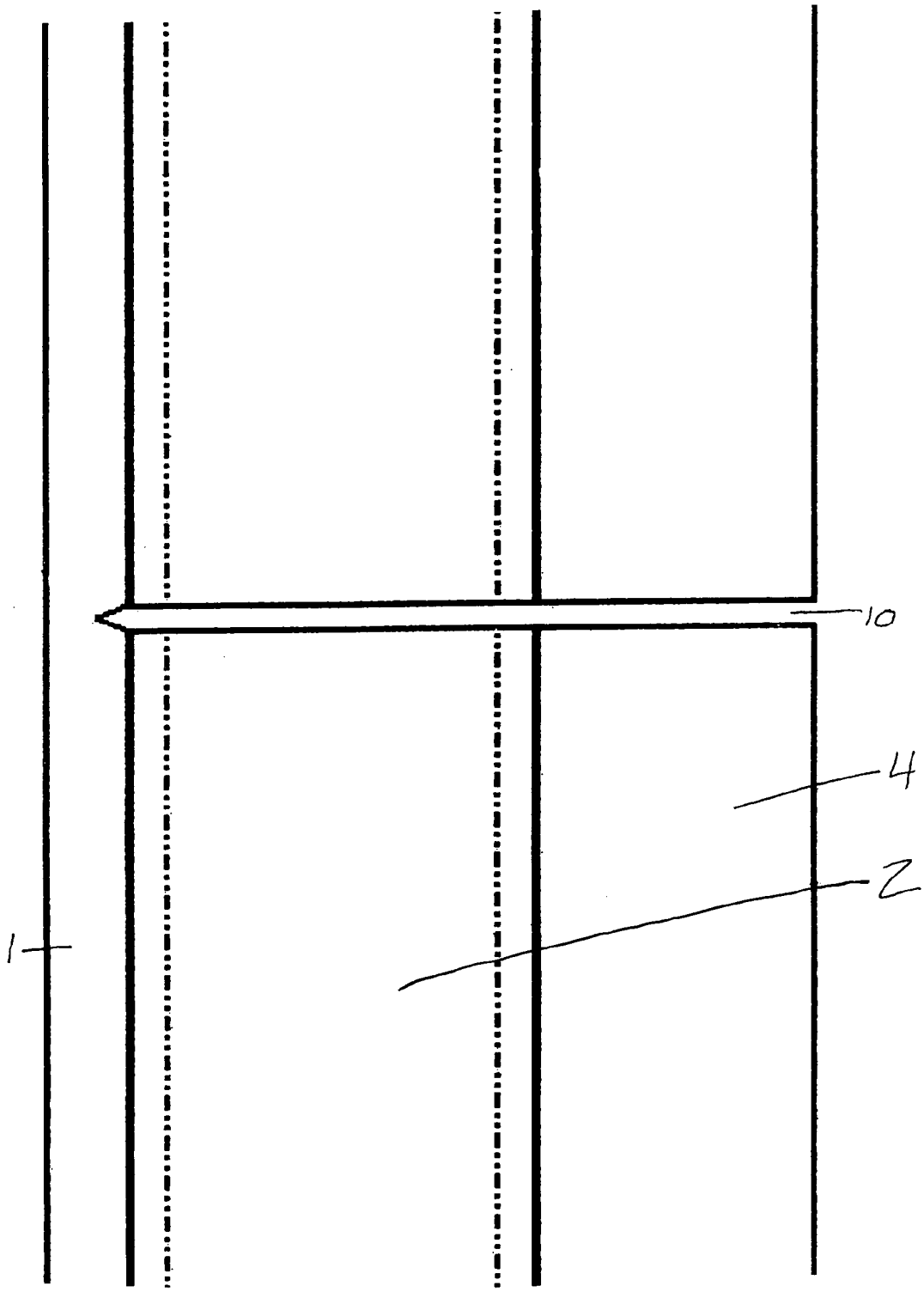
FIG. 10 shows a side view of the invention and the easy installation feature.

The staggering of the deflector vanes leads to a trapping effect whereby the urine is continually directed back toward the rear wall of the urinal and behind the barb like heads of the vanes (which prevents the urine from deflecting in a direction away from the rear wall of the urinal. Turning now to FIG. 1, The invention can be seen to have a planar base (1) from which long vanes (2) and short vanes (3) extend alternately. Each long vane (2) and each short vane (3) has a head (4) arranged distally from the base (1). The head (4) presents sharply angled surfaces toward the user of the urinal so there is no splash back toward the user as there would be if a perpendicular surface is exposed to the urine stream. Turning now to FIG. 2, the cross section of the invention is shown. Ideally, the angled surfaces of the heads (4) deflect the urine ever backward, away from the user, until it eventually reaches the channel (5) that is formed in the space between the long vane (2) and its adjacent short vane (3). The channels (5) run vertically to ensure that gravity causes the urine to flow down to the drain without impediment. The specific degree of the angle between the planes on the head (4) is not critical as long as it is an angle which causes the deflection of the urine in toward the channels rather than back toward the user. In the preferred embodiment the base (1) has notches (6) in the surface it presents to the channels (5). These notches (6) are there to make the invention easier for an installer to break or trim it to size to fit any urinal. Turning now to FIG. 3, the invention is shown as it would appear installed in a typical urinal (7). Only the heads (4) are visible because the overlap between them respectively ensures that no plane perpendicular to the urine stream is presented to the user. The invention is attached to the back wall of the urinal by an attachment means known to the art such as adhesives, suction cups, clamping device to existing urinal structure or molded into the urinal. Depending on the size and shape of the urinal including its side walls, the invention may even brace itself in place by its shape or springiness. Turning now to FIG. 4, the top edges of the base (1), long vanes (2), and short vanes (3) can be seen to be very sharp. Again, this is a measure to ensure that no perpendicular surface is presented to the urine stream so there is no splash back. Ideally, the urine impacts the invention against the heads, but if the urine should impact at the top of the invention, the sharp edges of the top will more likely guide the urine toward one of the channels (5) rather than back toward the user. At the top edge of the invention the ends of the long vanes (2) and short vanes (3) which are distal from where they attach to the base (1) begin as points (8) but gradually widen out to form the heads which are shown as (4) in FIG. 2. When the urinal is flushed, the water that trickles down also will not splash because of the sharpness of the top edges of the base (1) and vanes (2), (3) and the points (8). An alternative embodiment, shown at FIG. 5, would have angled vanes (9) which are respectively possessed of gradually increasing angles such that all the heads (4), as a group, converge toward the axis of the invention's user. An alternative embodiment, shown at FIG. 6, has heads (4) that are quadrangular in cross section rather than triangular. An alternative embodiment, shown at FIG. 7, has heads (4) which are planar. All of the heads (4) which are attached to long vanes (2) are at angles with respect to the base (1). All of the heads (4) which are attached to short vanes (3) are at other angles with respect to the base (1) presenting a broken array of surfaces angled away from the user. All these alternative embodiments would also ideally have the sharp leading edges and points at the top to minimize deflection of urine or flushing water at the top of the device. At FIG. 8 can be seen a depiction of the direction of urine flow when it has impacted the heads (4). The angles of the heads (4) causes the urine to be directed to the channels (5) where gravity will take it down to the urinal drain. In FIG. 9 the front of the invention can be seen much as in FIG. 1, except that a cut (10) can be seen which enables the installer to break the invention into handy lengths for installation in urinals of different sizes. This cut (10) is a feature that would be found in the preferred embodiment so the installer can easily trim the invention to size in the direction perpendicular to the trimming made easier by the notches (6) seen in FIG. 2. FIG. 10 shows the invention from a side edge so the cut (10) can be seen to extend through the head (4) and through the vanes, here shown as a long vane (2), and down partially into the base (1).

This invention can cheaply be manufactured in volume of many materials such as metal, plastic, or rubber. In the preferred embodiment, the invention will be made of a material which is sufficiently deformable so the invention can be installed into a urinal whose back wall curves or is a recessed angle as easily as it can be installed into a urinal which has a flat rear wall. There is nothing to retain odors as happens with the recesses of common mesh type anti-splash devices. The invention even presents a pleasing aesthetic appearance.

I claim:

1. A self-cleaning urinal anti-splash device comprising:

a plurality of angled deflectors facing a user of the device, each deflector being in the shape of an elongated vane with the cross section of each vane possessing a head that presents sharply angled surfaces;

a flat panel of sufficient size to accommodate a plurality of said angled deflectors arranged generally parallel to each other and generally perpendicular to said flat panel such that a plurality of channels are defined by said angled deflectors and said flat panel;

means for joining said angled deflectors to said flat panel;

each vane being formed at an end to be positioned at the top of the urinal, with a tapered deflector facing water dispensed by the urinal;

whereby, said device will prevent a stream of urine from returning back to a user and also allow the user to flush the urinal and clean the device.

2. The self-cleaning urinal anti-splash device of claim 1 wherein said angled deflectors are positioned in a staggered formation.

3. The self-cleaning urinal anti-splash device of claim 1 wherein said angled deflectors have a shape of an arrowhead.

4. The self-cleaning urinal anti-splash device of claim 1 wherein said flat panel would be molded into the urinal.

* * * * *